US007218301B2

(12) United States Patent
Credelle

(10) Patent No.: US 7,218,301 B2
(45) Date of Patent: May 15, 2007

(54) SYSTEM AND METHOD OF PERFORMING DOT INVERSION WITH STANDARD DRIVERS AND BACKPLANE ON NOVEL DISPLAY PANEL LAYOUTS

(75) Inventor: Thomas Lloyd Credelle, Morgan Hill, CA (US)

(73) Assignee: Clairvoyante, Inc, Sebastopol, CA (US)

( * ) Notice: Subject to any disclaimer, the term of this patent is extended or adjusted under 35 U.S.C. 154(b) by 0 days.

(21) Appl. No.: 10/455,931

(22) Filed: Jun. 6, 2003

(65) Prior Publication Data

US 2004/0246381 A1 Dec. 9, 2004

(51) Int. Cl.
*G09G 3/36* (2006.01)

(52) U.S. Cl. ..... 345/96; 345/88; 345/209

(58) Field of Classification Search ..... 345/87–104, 345/204, 694–696, 208–210
See application file for complete search history.

(56) References Cited

U.S. PATENT DOCUMENTS

| | | | | |
|---|---|---|---|---|
| 3,971,065 | A | 7/1976 | Bayer | |
| 4,353,062 | A | 10/1982 | Lorteije et al. | |
| 4,642,619 | A | 2/1987 | Togashi | |
| 4,651,148 | A | 3/1987 | Takeda et al. | |
| 4,773,737 | A | 9/1988 | Yokono et al. | |
| 4,781,438 | A | 11/1988 | Noguchi | |
| 4,800,375 | A | 1/1989 | Silverstein et al. | |
| 4,853,592 | A | 8/1989 | Stratham | |
| 4,874,986 | A | 10/1989 | Menn et al. | |
| 4,886,343 | A | 12/1989 | Johnson | |
| 4,908,609 | A | 3/1990 | Stroomer | |
| 4,920,409 | A | 4/1990 | Yamagishi | |
| 4,965,565 | A | 10/1990 | Noguchi | |
| 5,006,840 | A * | 4/1991 | Hamada et al. | 345/88 |
| 5,052,785 | A | 10/1991 | Takimoto et al. | |
| 5,097,297 | A | 3/1992 | Nakazawa | |
| 5,113,274 | A * | 5/1992 | Takahashi et al. | 349/109 |

(Continued)

FOREIGN PATENT DOCUMENTS

DE 299 09 537 U1 10/1999

(Continued)

OTHER PUBLICATIONS

Thomas Credelle, "P-O: MTF of High Resolution PenTile Matrix Displays".

(Continued)

*Primary Examiner*—Lun-Yi Lao

(57) ABSTRACT

A system and method are disclosed for performing dot inversion with standard drivers and backplane on novel display panel layouts. Suitable dot inversion schemes are implemented on a liquid crystal display having a panel and a driver circuit. The panel substantially comprises a subpixel repeating group, the group having a even number of subpixels across a first direction. The driver circuit comprises a set of drivers, coupled to the panel providing image data signals to the panel, the signals effecting substantially a dot inversion scheme to the panel. The drivers are also substantially connected to the columns of the panel in a sequence along the driver circuit wherein at least one driver is not connected to a column of the panel, and at least two subpixel regions of the panel having same colored subpixels in the two regions with substantially different polarities.

10 Claims, 4 Drawing Sheets

U.S. PATENT DOCUMENTS 5,144,288 A 9/1992 Hamada et al.
5,184,114 A 2/1993 Brown
5,191,451 A 3/1993 Katayama et al.
5,311,205 A 5/1994 Hamada et al.
5,311,337 A 5/1994 McCartney, Jr.
5,315,418 A 5/1994 Sprague et al.
5,334,996 A 8/1994 Tanigaki et al.
5,341,153 A 8/1994 Benzschawel et al.
5,398,066 A 3/1995 Martinez-Uriegas
5,436,747 A 7/1995 Suzuki
5,459,595 A 10/1995 Ishiguro
5,461,503 A 10/1995 Deffontaines et al.
5,485,293 A 1/1996 Robinder
5,535,028 A 7/1996 Bae et al.
5,563,621 A 10/1996 Silsby
5,579,027 A 11/1996 Sakurai et al.
5,646,702 A 7/1997 Akinwande et al.
5,648,793 A 7/1997 Chen
5,739,802 A 4/1998 Mosier
5,754,163 A 5/1998 Kwon
5,754,226 A 5/1998 Yamada et al.
5,767,829 A 6/1998 Verhulst
5,808,594 A 9/1998 Tsubyama et al.
5,818,405 A 10/1998 Eglit et al.
5,899,550 A 5/1999 Masaki
5,949,396 A 9/1999 Lee
5,971,546 A 10/1999 Park
6,005,692 A 12/1999 Stahl
6,008,868 A 12/1999 Silverbrook
6,037,719 A 3/2000 Yap et al.
6,064,363 A 5/2000 Kwon
6,088,050 A 7/2000 Ng
6,097,367 A 8/2000 Kuriwaki et al.
6,108,122 A 8/2000 Ulrich et al.
6,144,352 A 11/2000 Matsuda
6,147,664 A 11/2000 Hansen
6,151,001 A 11/2000 Anderson et al.
6,160,535 A 12/2000 Park
6,188,385 B1 2/2001 Hill et al.
6,219,019 B1 4/2001 Hasegawa
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,278,434 B1 8/2001 Hill et al.
6,326,981 B1 12/2001 Mori et al.
6,327,008 B1 12/2001 Fujiyoshi
6,332,030 B1 12/2001 Manjunath
6,335,719 B1 * 1/2002 An et al. ..... 345/98
6,342,876 B1 1/2002 Kim
6,348,929 B1 2/2002 Acharya
6,377,262 B1 4/2002 Hitchcock et al.
6,388,644 B1 5/2002 De Zwart et al.
6,393,145 B2 5/2002 Betrisey et al.
6,396,505 B1 5/2002 Lui
6,469,766 B2 10/2002 Waterman et al.
6,545,653 B1 4/2003 Takahara
6,552,706 B1 4/2003 Ikeda et al.
6,570,584 B1 5/2003 Cok et al.
6,590,555 B2 * 7/2003 Su et al. ..... 345/92
6,624,828 B1 9/2003 Dresevic et al.
6,661,429 B1 12/2003 Phan
6,674,430 B1 1/2004 Kaufman
6,674,436 B1 1/2004 Dresevic et al.
6,680,761 B1 1/2004 Greene et al.
6,714,212 B1 3/2004 Tsuboyama et al.
6,714,243 B1 3/2004 Mathur et al.
6,727,878 B2 4/2004 Okuzono et al.
6,738,204 B1 5/2004 Chuang et al.
6,750,875 B1 6/2004 Keely, Jr.
6,771,028 B1 8/2004 Winters
6,804,407 B2 10/2004 Weldy
6,833,888 B2 12/2004 Song et al.
6,927,754 B2 8/2005 Lai
2001/0015716 A1 8/2001 Kim
2001/0017607 A1 * 8/2001 Kwon et al. ..... 345/87
2001/0052897 A1 12/2001 Nakano et al.
2002/0015110 A1 2/2002 Brown Elliott
2002/0093476 A1 7/2002 Hill et al.
2002/0158997 A1 10/2002 Fukami et al.
2003/0006978 A1 1/2003 Fujiyoshi
2003/0011603 A1 1/2003 Koyama
2003/0071943 A1 4/2003 Choo et al.
2003/0077000 A1 4/2003 Blinn
2003/0090581 A1 5/2003 Credelle et al.
2003/0098837 A1 * 5/2003 Iwamoto et al. ..... 345/87
2003/0146893 A1 8/2003 Sawabe
2003/0218618 A1 11/2003 Phan
2004/0008208 A1 1/2004 Dresevic et al.
2004/0021804 A1 2/2004 Hong et al.
2004/0061710 A1 4/2004 Messing et al.
2004/0085495 A1 5/2004 Roh et al.
2004/0094766 A1 5/2004 Lee et al.
2004/0095221 A1 5/2004 Sigl
2004/0114046 A1 6/2004 Lee et al.
2004/0150651 A1 8/2004 Phan
2004/0169807 A1 9/2004 Rho et al.
2004/0174389 A1 9/2004 Ben-David et al.
2004/0179160 A1 9/2004 Rhee et al.
2004/0213449 A1 10/2004 Safaee-Rad
2004/0223005 A1 11/2004 Lee
2004/0239837 A1 12/2004 Hong et al.
2004/0246213 A1 12/2004 Credelle et al.
2004/0246278 A1 12/2004 Elliott
2004/0246279 A1 12/2004 Credelle et al.
2004/0246280 A1 12/2004 Credelle et al.
2004/0246404 A1 12/2004 Elliott et al.
2004/0247070 A1 12/2004 Ali
2005/0083277 A1 4/2005 Credlle
2005/0151752 A1 7/2005 Phan
2005/0162600 A1 7/2005 Rho et al.
2005/0212728 A1 9/2005 Miller et al.

FOREIGN PATENT DOCUMENTS

DE 199 23 527 A1 11/2000
DE 201 09 354 U1 9/2001
EP 0 322 106 A2 6/1989
EP 0 203 005 A1 11/1989
EP 1 381 020 A2 1/2004
GB 2 146 478 A 4/1985
GB 2 282 928 A 4/1995
JP 60-107022 6/1985
JP 03-78390 4/1991
JP 06-102503 4/1994
JP 06-324649 * 11/1994
JP 08-202317 8/1996
JP 11-282008 10/1999
JP 2004-4822 8/2004
JP 2004-78218 11/2004
WO WO 2004/027503 11/2002
WO WO 02/099557 A2 12/2002
WO WO 02/101644 A2 12/2002
WO WO 2004/017129 A1 2/2004
WO WO 2004/086128 3/2004
WO WO 2004/086128 A1 7/2004

OTHER PUBLICATIONS

Scott Daly, "Analysis of Subtriad Addressing Algorithms by Visual System Models".

Candice Elliott, "Active Matrix Display . . . ", IDMC 2000, 185-189, Feb. 8, 2000.
Candice Elliott, "Color Subpixel Rendering Projectors amd Flat Panel Displays", SMPTE, Feb. 17-Mar. 1, 2003, Seattle.
Michiel Klompenhouwer, Subpixel Image Scaling for Color Matrix Displays, SID Symp. Digest, May 2002.
John Krantz et al., "Color Matrix Display Image Quality : The Effects of Luminance . . . " SID 90 Digest.
Baek-Woon Lee et al., "40.5L: Late-News Paper: TFT-LCD with RGBW Color System", SID 03 Digest, 2003.
Dean Messing et al., Improved Display Resolution of Subampled Colour Images Using Subpixel Addressing, IEEE ICIP 2002.
Dean Messing et al., "Subpixel Rendering on Non-Striped Colour Matrix Displays", 2003 International Conf. on Image Processing, Sep. 2003, Barcelona, Spain.
Okumura et al., "A New Flicker-Reduction Drive Method for High REsolution LCTVs", SID Digest, 551-554, 2001.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "Development of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Pentile Matrix™ Displays and Drivers" ADEAC Proceedings Paper, Portland OR., Oct. 2005.
Brown Elliott, C, "Reducing Pixel Count Without Reducing Image Quality", Information Display Dec. 1999, vol. 1, pp. 22-25.
USPTO, Non-Final Office Action dated Jan. 23, 2006 in US Patent Publication No. 2004/0246278 (U.S. Appl. No. 10/455,927).
Clairvoyante Inc, Response to Non-Final Office Action dated May 19, 2006 in US Patent Publication No. 2004/0246278 (U.S. Appl. No. 10/455,927).
USPTO, Final Office Action dated Aug. 9, 2006 in US Patent Publication No. 2004/0246278 (U.S. Appl. No. 10/455,927).
Clairvoyante Inc, Response to Final Office Action dated Aug. 2, 2006 in US Patent Publication No. 2004/0246279 (U.S. Appl. No. 10/456,806).
USPTO, Non-Final Office Action dated Sep. 2, 2004 in US Patent Publication No. 2004/0246404 (U.S. Appl. No. 10/456,838).
Clairvoyante Inc, Response to Non-Final Office Action dated Jan. 28, 2005 in US Patent Publication No. 2004/0246404 (U.S. Appl. No. 10/456,838).
USPTO, Final Office Action dated Jun. 9, 2005 in US Patent Publication No. 2004/0246404 (U.S. Appl. No. 10/456,838).
Clairvoyante Inc, Response to Final Office Action dated Dec. 5, 2005 in US Patent Publication No. 2004/0246404 (U.S. Appl. No. 10/456,838).
USPTO, Non-Final Office Action dated Mar. 20, 2006 in US Patent Publication No. 2004/0246404 (U.S. Appl. No. 10/456,838).
Clairvoyante Inc, Response to Non-Final Office Action dated Aug. 4, 2006 in US Patent Publication No. 2005/0083277 (U.S. Appl. No. 10/696,236).

* cited by examiner

Φ1: +-+-+-...

Φ2: -+-+-+...

SYSTEM AND METHOD OF PERFORMING DOT INVERSION WITH STANDARD DRIVERS AND BACKPLANE ON NOVEL DISPLAY PANEL LAYOUTS

RELATED APPLICATIONS

The present application is related to commonly owned (and filed on even date) U.S. Patent Applications: (1) U.S. patent publication Ser. No. 2004/0246213 ("the '213 application") [United States patent application Ser. No. 10/455,925] entitled "DISPLAY PANEL HAVING CROSSOVER CONNECTIONS EFFECTING DOT INVERSION"; and (2) U.S. patent publication Ser. No. 2004/0246278 ("the '278 application") [U.S. patent application Ser. No. 10/455,927] entitled "SYSTEM AND METHOD FOR COMPENSATING FOR VISUAL EFFECTS UPON PANELS HAVING FIXED PATTERN NOISE WITH REDUCED QUANTIZATION ERROR"; (3) U.S. patent publication Ser. No. 2004/0246279 ("the '279 application") [U.S. patent application Ser. No. 10/456,806] entitled "DOT INVERSION ON NOVEL DISPLAY PANEL LAYOUTS WITH EXTRA DRIVERS"; (4) U.S. patent publication Ser. No. 2004/0246404 ("the '404 application") [U.S. patent application Ser. No. 10/456,838] entitled "LIQUID CRYSTAL DISPLAY BACKPLANE LAYOUTS AND ADDRESSING FOR NON-STANDARD SUBPIXEL ARRANGEMENTS"; and (5) U.S. patent publication Ser. No. 2004/0246280 ("the '280 application") [U.S. patent application Ser. No. 10/456,839] entitled "IMAGE DEGRADATION CORRECTION IN NOVEL LIQUID CRYSTAL DISPLAYS," which are hereby incorporated herein by reference.

BACKGROUND

In commonly owned U.S. Patent Applications: (1) U.S. patent publication Ser. No. 2002/0015110 ("the '110 application") [U.S. patent application Ser. No. 09/916,232], entitled "ARRANGEMENT OF COLOR PIXELS FOR FULL COLOR IMAGING DEVICES WITH SIMPLIFIED ADDRESSING," filed Jul. 25, 2001; (2) U.S. patent publication Ser. No. 2003/0128225 ("the '225 application") [U.S. patent application Ser. No. 10,278,353], entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) U.S. patent publication Ser. No. 2003/0128179 ("the '179 application") [U.S. patent application Ser. No. 10/278,352], entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) U.S. patent publication Ser. No. 2004/0051724 ("the '724 application") [U.S. patent application Ser. No. 10/243,094], entitled "IMPROVED FOUR COLOR ARRANGEMENTS AND EMITTERS FOR SUB-PIXEL RENDERING," filed Sept. 13, 2002; (5) U.S. patent publication Ser. No. 2003/0117423 ("the '423 application") [U.S. patent application Ser. No. 10/278,328], entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) U.S. patent publication Ser. No. 2003/0090581 ("the '581 application") [U.S. patent application Ser. No. 10/278,393], entitled "COLOR DISPLAY HAVING HORIZONTAL SUB-PIXEL ARRANGEMENTS AND LAYOUTS," filed Oct. 22, 2002; (7) U.S. patent publication Ser. No. 2004/0080479 ("the '479 application") [U.S. patent application Ser. No. 10/347,001] entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, novel sub-pixel arrangements are therein disclosed for improving the cost/performance curves for image display devices and herein incorporated by reference.

These improvements are particularly pronounced when coupled with sub-pixel rendering (SPR) systems and methods further disclosed in those applications and in commonly owned U.S. Patent Applications: (1) U.S. patent publication Ser. No. 2003/0034992 ("the '992 application") [U.S. patent application Ser. No. 10/051,612] entitled "CONVERSION OF A SUB-PIXEL FORMAT DATA TO ANOTHER SUB-PIXEL DATA FORMAT," filed Jan. 16, 2002; (2) U.S. patent publication Ser. No. 2003/0103058 ("the '058 application") [U.S. patent application Ser. No. 10/150,355], entitled "METHODS AND SYSTEMS FOR SUB-PIXEL RENDERING WITH GAMMA ADJUSTMENT," filed May 17, 2002; (3) U.S. patent publication Ser. No. 2003/0085906 ("the '906 application") [U.S. patent application Ser. No. 10/215,843], entitled "METHODS AND SYSTEMS FOR SUB-PIXEL RENDERING WITH ADAPTIVE FILTERING," filed Aug. 8, 2002; (4) U.S. patent publication Ser. No. 2004/0196302 ("the '302 application") [U.S. patent application Ser. No. 10/379,767] entitled "SYSTEMS AND METHODS FOR TEMPORAL SUB-PIXEL RENDERING OF IMAGE DATA" filed Mar. 4, 2003; (5) U.S. patent publication Ser. No. 2004/0174380 ("the '380 application") [U.S. patent application Ser. No. 10/379,765] entitled "SYSTEMS AND METHODS FOR MOTION ADAPTIVE FILTERING," filed Mar. 4, 2003; (6) U.S. patent publication Ser. No. 2004/0174375 ("the '375 application") [U.S. patent application Ser. No. 10/379,766] entitled "SUB-PIXEL RENDERING SYSTEM AND METHOD FOR IMPROVED DISPLAY VIEWING ANGLES" filed Mar. 4, 2003; (7) U.S. patent publication Ser. No. 2004/0196297 ("the '297 application") [U.S. patent application Ser. No. 10/409,413] entitled "IMAGE DATA SET WITH EMBEDDED PRE-SUBPIXEL RENDERED IMAGE" filed Apr. 7, 2002, which are hereby incorporated herein by reference.

BRIEF DESCRIPTION OF THE DRAWINGS

The accompanying drawings, which are incorporated in, and constituted a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1A:
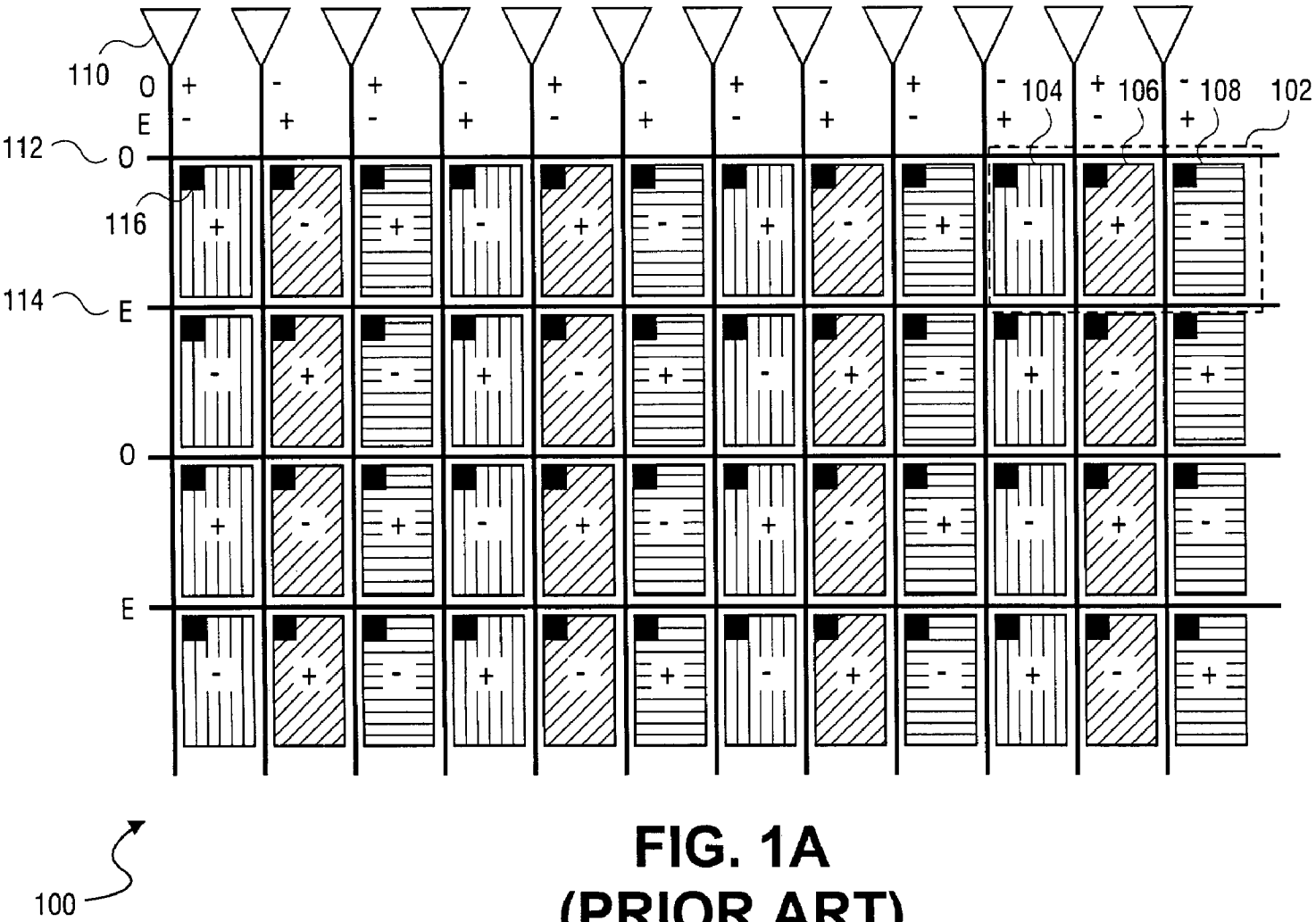
FIG. 1A (PRIOR ART)
FIG. 1A depicts a typical RGB striped panel display having a standard 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel from a repeating group of subpixels 102 that comprise the panel.

As also shown, each subpixel is connected to a column line (each driven by a column driver 110) and a row line (e.g. 112 and 114). In the field of AMLCD panels, it is known to drive the panel with a dot inversion scheme to reduce crosstalk and flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("O") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
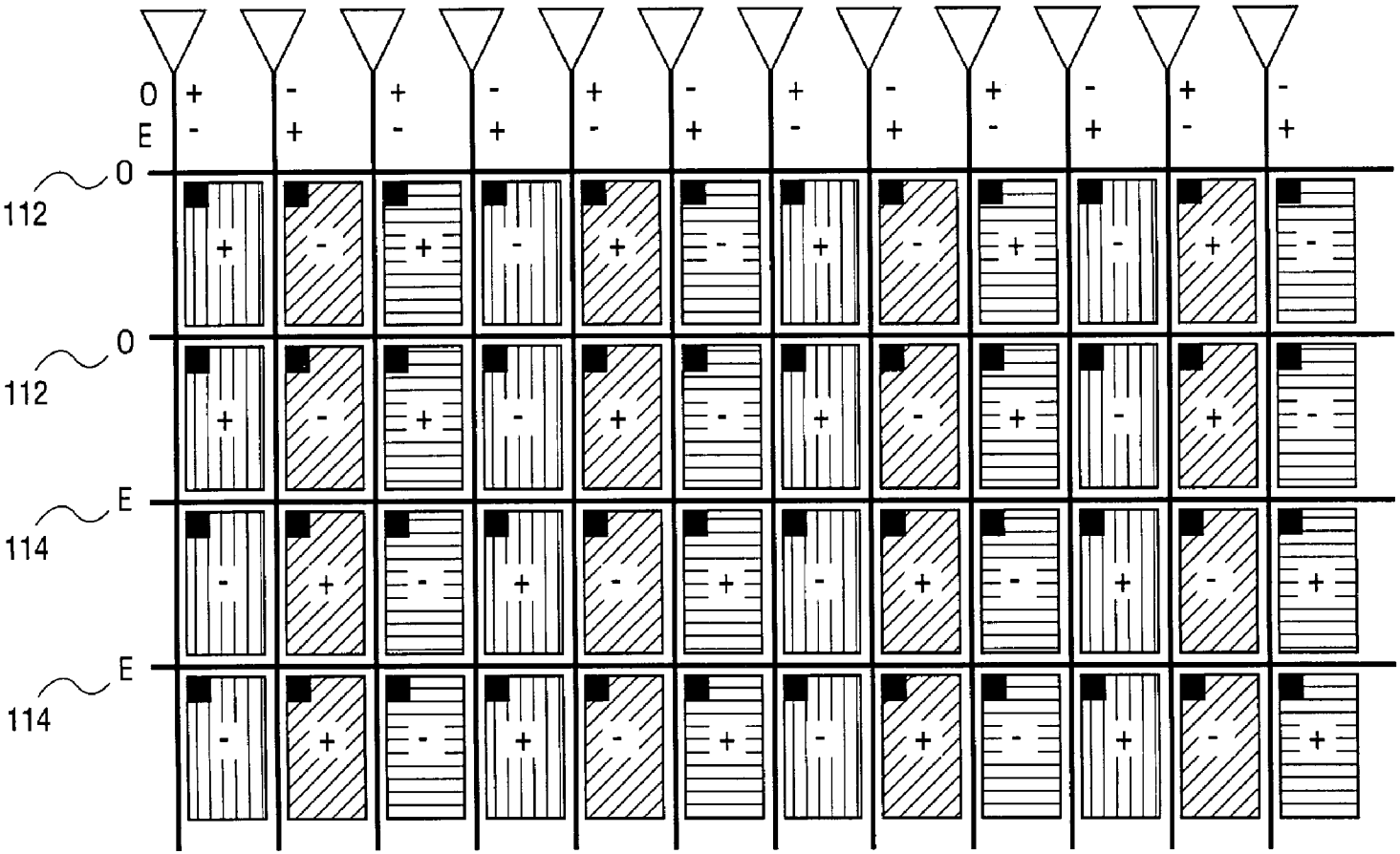
FIG. 1B (PRIOR ART)
FIG. 1B depicts a typical RGB striped panel display having a standard 1×2 dot inversion scheme.

FIG. 1B depicts another conventional RGB stripe panel having another dot inversion scheme—i.e. 1×2 dot inversion. Here, the polarity scheme changes over the course of tow rows as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, fore example, two successive red subpixels along a row will be either (+, −) or (−, +). Of course, in 1×1 dot inversion, two successive red subpixels along a column will have opposite polarity; whereas in 1×2 dot inversion, each group of two successive red subpixels will have opposite polarity. This changing of polarity decreases noticeable visual effects that occur with particular images rendered upon an AMLCD panel. It is generally known that the visual defects vertically will be minimal if the polarity of the same-color pixels changes frequently, but not necessarily every row; thus the 1×2 dot inversion is acceptable.

Figure 2:
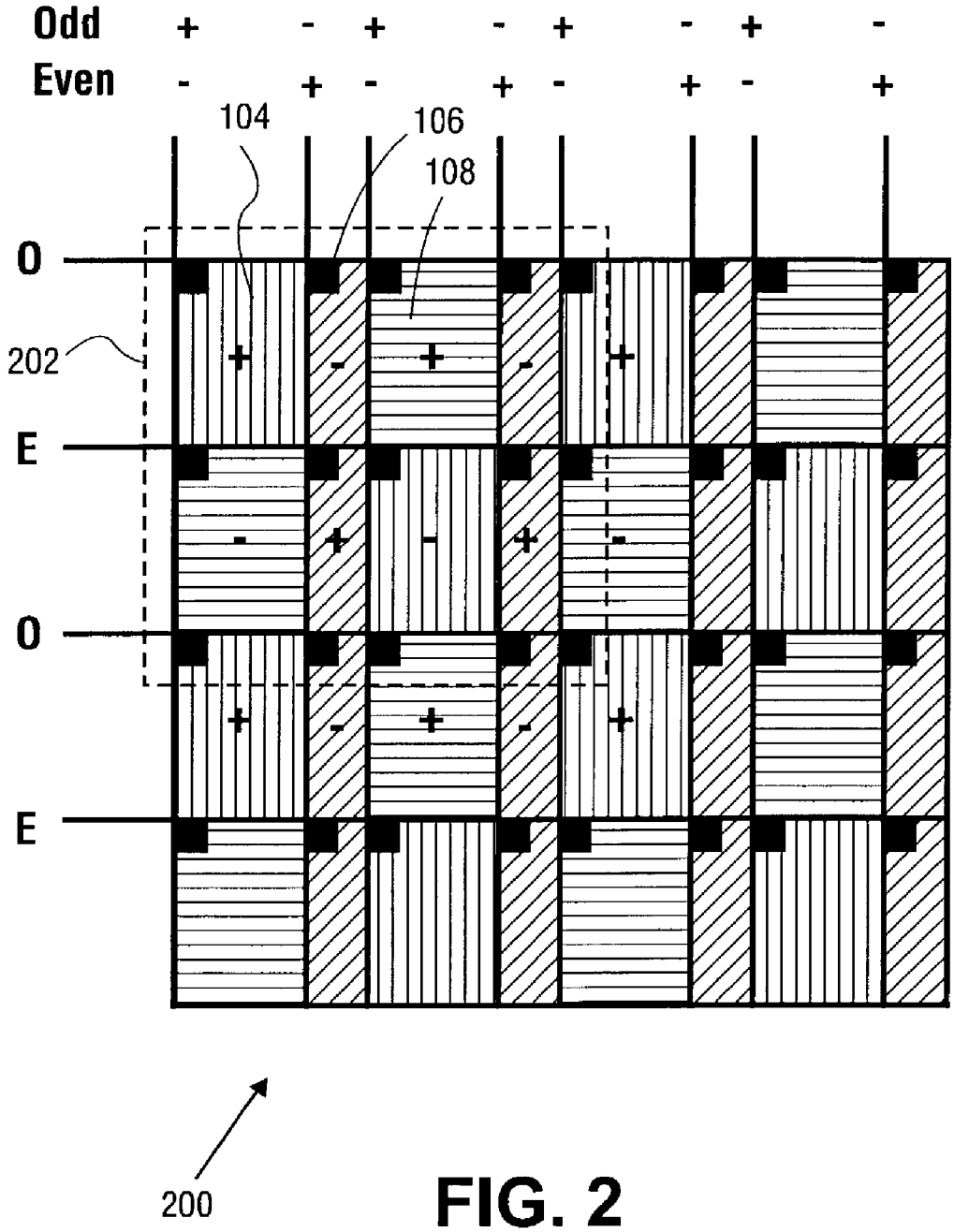
FIG. 2 depicts a novel panel display comprising a sub-pixel repeat grouping that is of even modulo.

FIG. 2 shows a panel comprising a repeat subpixel grouping 202, as further described in the '225 application. As may be seen, repeat subpixel grouping 202 is an eight subpixel repeat group, comprising a checkerboard of red and blue subpixels with two columns of reduced-area green subpixels in between. If the standard 1×1 dot inversion scheme is applied to a panel comprising such a repeat grouping (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeat grouping—for example, the subpixel repeat grouping in FIG. 1 of the '179 application—and other repeat groupings that are not an odd number of repeating subpixels across a row. Thus, as the traditional RGB striped panels have three such repeating subpixels in its repeat group (namely, R, G and B), these traditional panels do not necessarily violate the above noted conditions. However, the repeat grouping of FIG. 2 in the present application has four (i.e. an even number) of subpixels in its repeat group across a row (e.g. R,G,B, and G). It will be appreciated that the embodiments described herein are equally applicable to all such even modulus repeat groupings.

In the '110 co-pending application, there is disclosed various layouts and methods for remapping the TFT backplane so that, although the TFTs of the subpixels may not be regularly positioned with respect to the pixel element itself (e.g. the TFT is not always in the upper left hand corner of the pixel element), a suitable dot inversion scheme may be effected on a panel having an even modulo subpixel repeat grouping. Other possible solutions are disclosed in the co-pending applications noted above.

Figure 3:
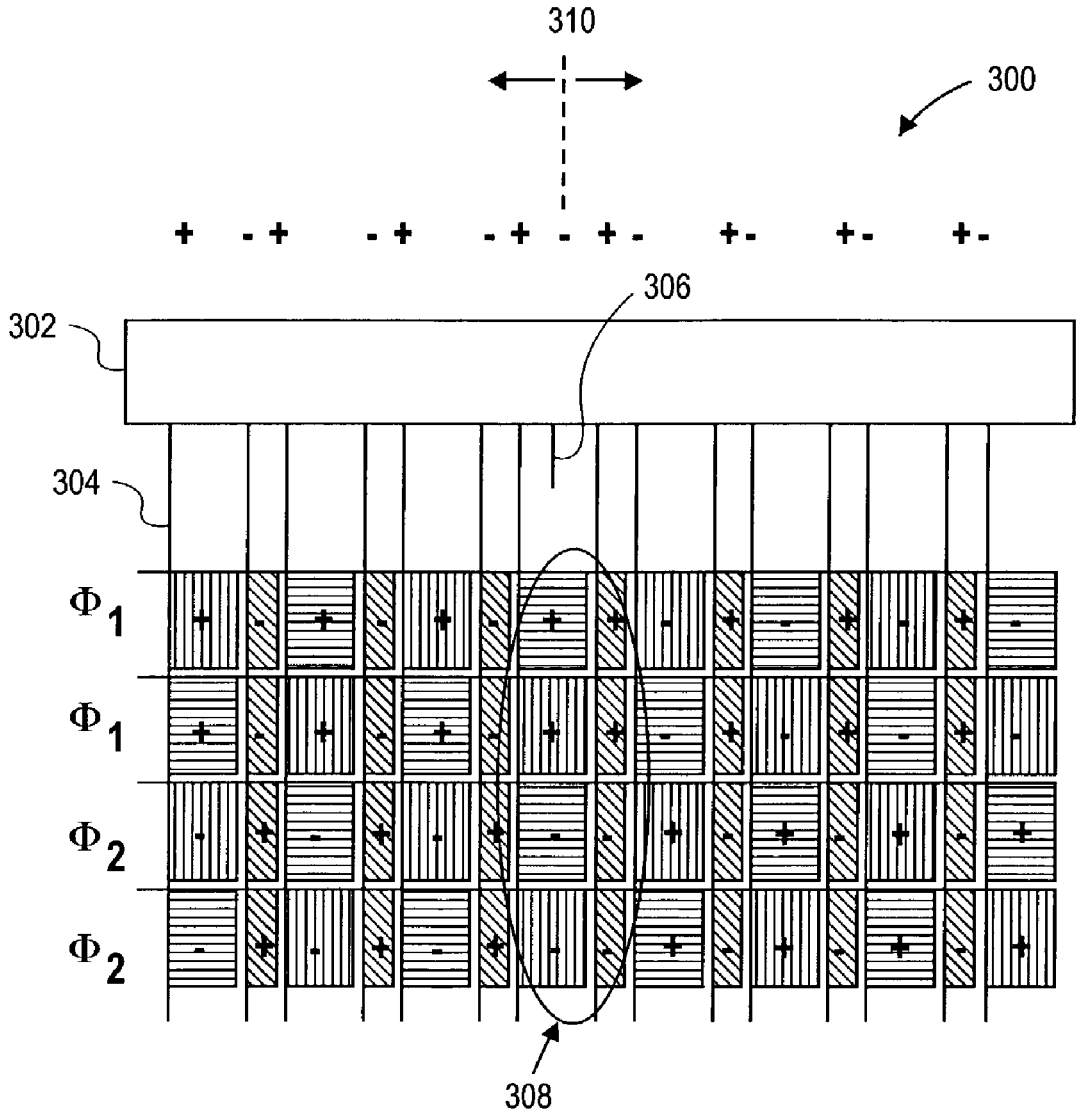
FIG. 3 depicts the panel display of FIG. 2 with one column driver skipped to provide a dot inversion scheme that may abate some undesirable visual effects.

One possible implementation that would not necessarily require a redesign of the TFT backplane or column driver chips is shown below in FIG. 3. Panel 300 comprises the subpixel repeating group as shown in FIG. 2. Column driver chip 302 connects to panel 300 via column lines 304. Chip 302, as shown, effects a 1×2 dot inversion scheme on panel 300—as indicated by the "+" and "−" polarities indicated in each subpixel. The phase of pluses and minuses are indicated by the nomenclature $\phi$1 and $\phi$2.

As may be seen, at certain points along chip 302, there are column drivers that are not used (as indicated by short column line 306). "Skipping" a column driver in such a fashion on creates the desirable effect of providing alternating areas of dot inversion for same colored subpixels. For example, on the left side of dotted line 310, it can be seen that the red colored subpixels along a given row have the same polarity. However, on the right side of dotted line 310, the polarities of the red subpixels change. This change may have the desired effect of eliminating or abating any visual shadowing effects that might occur as a result of same-colored subpixel all having the same polarity.

This column driver skipping may be accomplished often enough across an entire panel to reduce or eliminate shadowing effects. How many times and in any given pattern may be determined heuristically. One possible side effect of skipping column drivers might be that at the columns where the driver is skipped, those adjoining columns have the same polarities going down the column line. This may have an undesirable visual effect, such as producing a darker or lighter column at this point—as depicted as oval 308.

As is known upon manufacture of the panel itself where these skipped column drivers are on the panel, it is possible to compensate for any undesirable visual effect. As described in copending and commonly assigned U.S. patent application Ser. No. 10/455,927, entitled "SYSTEM AND METHOD FOR COMPENSATING FOR VISUAL EFFECTS UPON PANELS FIXED PATTERN NOISE WITH REDUCED QUANTIZATION ERROR" which is published as U.S. patent application Ser. No. 2004/0246278 and incorporated herein by reference, there are techniques that may be employed to reduce or possibly eliminate these visual effects. For example, a noise pattern may be introduced to the potential effected columns such that known or estimated darkness or brightness produced by such columns is adjusted. For example, if the column in question is slightly darker than those surrounding columns then the darker column may be adjusted to be slightly more ON than its neighbors.

It will be appreciated that, although it might be the easiest to skip one driver in the sequence of drivers along the driver circuit—and thereby having two adjacent columns of subpixels driven with the same polarity (thus, creating different regions of same colored subpixel polarity along a row), that there are other ways (perhaps less easy) to implement this effect. For example, it is possible to skip several (e.g. 3, 5, etc) drivers along a driver circuit to accomplish the same result. Additionally, it might be possible to skip drivers that are not in sequence and achieve the same desired effect with crossover connections or other interconnects. It suffices for the purposes of the present invention that a certain number of drivers are not used to create a more visually appealing panel.

Additionally, the technique of skipping drivers along a driver circuit is easily implemented with standard driver circuits wherein drivers in a sequence alternate polarity themselves. However, it is within the scope of the present invention whereby specialty driver circuits are constructed such that at least two adjacent drivers have the same polarity and thus the regions of different polarities of same colored subpixels may be effected by connecting these specialty drivers sequentially along the driver circuit.

The number of places or regions where same colored subpixel polarity is reversed can be determined heuristically or empirically. It suffices that such polarity reversals occur often enough to produce a panel that has user acceptability.

What is claimed is:

1. A liquid crystal display comprising:

a panel substantially comprising a subpixel repeating group, the subpixel repeating group having an even number of subpixels disposed in one of a row and column direction on said panel, wherein the subpixel repeating group comprises four colored subpixels disposed in said direction; and a driver circuit, comprising a set of drivers, coupled to the panel providing image data signals to the panel, the signals effecting substantially a polarity scheme to the panel, the drivers being substantially connected to subpixels disposed in one of the columns and rows of the panel in a sequence along the driver circuit wherein at least one driver is not connected to said subpixels of the panel, and wherein, in at least first and second subpixel regions of the panel, each of said four colored subpixels disposed in said direction in the second subpixel region have different polarities than each of said four colored subpixels disposed in said direction in the first subpixel region.

2. The liquid crystal display of claim 1, wherein the polarity scheme is a 1×1 dot inversion scheme.

3. The liquid crystal display of claim 1, wherein the polarity scheme is a 1×2 dot inversion scheme.

4. The liquid crystal display of claim 1, wherein the number of subpixel regions having the same colored subpixels with different polarities occur with a frequency such that undesirable visual effects are abated.

5. The liquid crystal display of claim 1, wherein the subpixel repeating group comprises a sequence of red R green G blue B green G colored subpixels disposed in said first direction.

6. A method for effecting a polarity scheme upon subpixels of a liquid crystal display, the display substantially comprising a subpixel repeat grouping having an even number of subpixels disposed in one of a row and column direction of the liquid crystal display, and wherein the subpixel repeating group comprises at least four colored subpixels disposed in said direction, the method comprising:

determining at least first and second regions of subpixels in which same colored subpixels disposed in said direction have the same polarity;

connecting a driver circuit having a plurality of drivers to one of row and column lines coupled to said subpixels such that at least one driver is not coupled to said subpixels; and applying a polarity scheme to the subpixels by way of said plurality of drivers connected to said subpixels in order to provide alternating regions of polarity for said same colored subpixels such that each of said four colored subpixels disposed in said direction in the second subpixel region have different polarities than each of said four colored subpixels disposed in said direction in the first subpixel region.

7. The method of claim 6, further comprising:

providing a sufficient number of adjacent regions with different polarities for said same colored subpixels with a frequency of polarity changes to abate undesirable visual effects.

8. The method of claim 6 wherein the polarity scheme is a 1×1 dot inversion scheme.

9. The method of claim 6 wherein the polarity scheme is a 1×2 dot inversion scheme.

10. The method of claim 6 wherein the subpixel repeating group comprises a sequence of red R green G blue B green G colored subpixels disposed in said first direction.

* * * * *